United States Patent [19]

Franke et al.

[11] 4,108,308

[45] Aug. 22, 1978

[54] PACKAGE FOR INTRAORAL DENTAL X-RAY FILMS

[75] Inventors: Kurt Franke; Johannes Seissl; Wilhelm Stuermer, all of Erlangen, Germany

[73] Assignee: Siemens Aktiengesellschaft, Berlin & Munich, Germany

[21] Appl. No.: 739,136

[22] Filed: Nov. 5, 1976

[30] Foreign Application Priority Data

Nov. 10, 1975 [DE] Fed. Rep. of Germany ..... 7535699

[51] Int. Cl.[2] ..... B81D 81/20; B03B 41/18

[52] U.S. Cl. ..... 206/455; 250/478

[58] Field of Search ..... 206/455, 454; 250/477, 250/478

[56] References Cited

U.S. PATENT DOCUMENTS

| | | | |
|---|---|---|---|
| 2,049,497 | 8/1936 | Gideon | 250/478 |
| 2,071,110 | 2/1937 | Burke | 206/455 |
| 2,974,229 | 3/1961 | Schmidt et al. | 250/478 |
| 3,443,093 | 5/1969 | Lindenmuth et al. | 206/455 |
| 3,958,693 | 5/1976 | Greene | 206/455 |
| 3,986,609 | 10/1976 | Marsh et al. | 250/478 |

FOREIGN PATENT DOCUMENTS

| | | | |
|---|---|---|---|
| 2,229,819 | 2/1973 | Fed. Rep. of Germany | 206/455 |

*Primary Examiner*—William Price
*Assistant Examiner*—Joseph M. Moy
*Attorney, Agent, or Firm*—Hill, Gross, Simpson, Van Santen, Steadman, Chiara & Simpson

[57] ABSTRACT

A package for intraoral dental X-ray film comprised of a plastic pouch having an X-ray film with a selectively removable intensifier foil positioned on at least one side thereof within the interior of such pouch.

2 Claims, 2 Drawing Figures

PACKAGE FOR INTRAORAL DENTAL X-RAY FILMS

BACKGROUND OF THE INVENTION

1. Field of the Invention

The invention relates to film packages and somewhat more particularly to packages for intraoral dental X-ray films.

2. Prior Art

Intraoral dental photographs are, in terms of numbers, the most frequent type of X-ray photograph taken. Even if the radiation dosage per dental photograph is not overly large, nevertheless, the radiation exposure of dental patients must be limited. Accordingly, a need exists for reducing the radiation exposure to which a patient may be subjected during the preparation of an intraoral dental photograph.

SUMMARY OF THE INVENTION

The invention provides an improved package for intraoral dental X-ray films.

In accordance with the principles of the invention, an X-ray film is provided with at least one selectively removable intensifier foil and such film-foil structure is placed within a plastic pouch so that good contact between the intensifier foil and the X-ray film is provided.

In one embodiment of the invention, the plastic pouch is evacuated so that the walls thereof collapse about the film-foil structure and after the X-ray photograph is taken and the pouch opened, the intensifier foil can be simply removed from the exposed X-ray film.

In another embodiment of the invention, the X-ray film and the intensifier foil are maintained in contact with one another by a suitable adhesive coating therebetween.

DESCRIPTION OF THE PREFERRED EMBODIMENTS

The invention provides an improved package for intraoral dental X-ray films whereby less radiation is required to prepare intraoral photographs.

In accordance with the principles of the invention, an X-ray film is provided with at least one intensifier foil having a photo-luminescent layer thereon and such film-foil structure is sealed within a plastic pouch so that there is good contact between the film and foil during the preparation of the intraoral photograph and thereafter the film and foil may be separated as desired. In accordance with the principles of the invention, an intensifier foil is pressure-contacted with an X-ray film. The invention thus combines known intensifier foils with X-ray films to achieve safer preparation of intraoral dental photographs. As is known, intensifier foils convert X-ray radiation into visible light and, in the combination of the invention, effect an additional exposure of the X-ray films by such visible light so that less X-ray radiation dosages are required. In order to provide a good and sufficient recognition of details in the dental area under examination, it is necessary to insure that the intensifier foil is in full contact with the photosensitive layer of the X-ray film.

Figure 1:
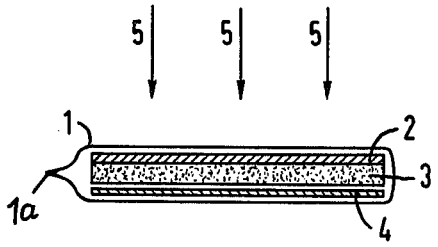
FIG. 1 is an elevated, somewhat schematic view of one embodiment of a film package constructed in accordance with the principles of the invention undergoing an X-ray exposure.

Referring now to FIG. 1, a film pouch 1 of conventional shape and comprised of plastic, for example, polyethylene or polyester, is sealed in an air-impermeable manner, as by heat-sealing at point 1*a*. Of course, other plastics and other means of providing a suitable seal may also be utilized. A sheet of an X-ray film 2 having on one surface thereof an intensifier foil 3 with a layer of photo-luminescent material thereon is positioned within the interior of the pouch 1. A metal foil 4 is also positioned within the pouch between the intensifier foil 3 and the interior wall of pouch 1 in order to absorb any X-rays which may otherwise pass through a pouch. This pouch may then be placed within a patient's mouth so that the X-rays act on the X-ray film 2 in the direction of arrows 5. The photo-luminescent layer of the intensifier foil 3 converts such X-rays into visible light which then further exposes the X-ray film 2. The metal foil 4 insures that as few X-rays as possible emerge from the side of the film pouch 1 which is not facing the X-ray radiation source (not shown) when such film pouch is introduced into the mouth of a patient undergoing dental examination.

In the embodiment shown at FIG. 1, secure pressure contact between the intensifier foil 3 and the X-ray film 2 is achieved by evacuating the interior of the film pouch 1 after the film and intensifier foil are positioned therein. The walls of the pouch are, via atmospheric pressure, forced tightly against the elements 2–4 within the pouch and these elements are then pressed against one another by exterior air pressure.

In the practice of the invention, it is advisable to use an intensifier foil having finely delineating properties (i.e., fine grained) in order to insure that there is a good and sufficient recognition of any details in the dental area being examined.

In another embodiment of the invention, an additional intensifier foil, in addition to the foil 3, may be utilized. This further intensifier foil is positioned, viewed in the radiation direction (i.e., from the X-ray radiation source) in front of the X-ray film so that there is an intensifier foil on both sides of the X-ray film.

Figure 2:
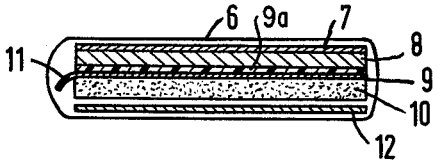
FIG. 2 is a somewhat similar view of another embodiment of a film package constructed in accordance with the principles of the invention.

FIG. 2 illustrates another embodiment of the invention wherein a film pouch 6 has an interior chamber therein which is not evacuated. A sheet of X-ray film within such chamber is shown as being comprised of a film carrier 7 and a film emulsion layer 8, i.e., the actual photosensitive film layer. An intensifier foil having one side thereof coated with a suitable pressure-sensitive adhesive is pasted onto the film emulsion layer 8 so that the X-ray film may be selectively removed from such intensifier foil. As shown, the intensifier foil is comprised of a carrier layer 9 in adhesive layer 9*a* and a photo-luminescent layer 10. The carrier layer 9 may be provided with a strap or extension 11 which protrudes beyond the lateral edge of the other elements within the pouch so as to enable one to readily remove the intensifier foil from the X-ray film. A metal foil 12 is also positioned within the pouch 6 between the interior wall of the pouch 6 and the intensifier foil so as to absorb any radiation.

Since the intensifier foil 9, 10 is actually positioned onto the film emulsion layer 8, an adequate contact between these elements is insured so that a fine recording of details results. Prior to development of the X-ray film 7, 8, the intensifier foil 9, 10 is removed, as by pulling, from the film by means of the extension 11.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. An X-ray film package for preparation of intraoral dental X-ray photographs comprising in combination, a pouch having an interior chamber, a sheet of X-ray film having an emulsion layer and positioned within such chamber, and an intensifier foil comprising two surfaces, a photo-luminescent layer on one surface thereof and an adhesive layer coated on another surface thereof, said adhesive coated surface of the intensifier foil being in intimate contact with said emulsion layer and said adhesive coated surface allowing separation of said film and said intensifier foil.

2. An X-ray film package as defined in claim 1 wherein said intensifier foil includes an extension which protrudes beyond the lateral edge of said X-ray film so as to facilitate removal of the intensifier foil from said film.

* * * * *